United States Patent [19]

Moring, III et al.

[11] Patent Number: 4,924,968

[45] Date of Patent: May 15, 1990

[54] STAMP FORMED MUFFLER WITH REINFORCED OUTER SHELL

[75] Inventors: Walter G. Moring, III; Jon W. Harwood, Toledo, both of Ohio

[73] Assignee: AP Parts Manufacturing Company, Toledo, Ohio

[21] Appl. No.: 227,807

[22] Filed: Aug. 3, 1988

[51] Int. Cl.[5] ..... F01N 1/02; F01N 7/18

[52] U.S. Cl. ..... 181/282; 181/243; 181/266; 181/268; 181/272

[58] Field of Search ..... 181/228, 239–255, 181/266–269, 272, 276, 282

[56] References Cited

U.S. PATENT DOCUMENTS

| | | | |
|---|---|---|---|
| 705,357 | 7/1902 | Keating . | |
| 1,110,040 | 9/1914 | Chatain . | |
| 2,484,827 | 10/1949 | Harley . | |
| 2,658,580 | 11/1953 | Trembley . | |
| 2,860,722 | 11/1958 | Gerstung . | |
| 2,943,695 | 7/1960 | Jeffords | 181/243 |
| 3,125,182 | 3/1964 | Earley . | |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,198,284 | 8/1965 | Powers | 181/266 |
| 3,412,825 | 11/1968 | Hall | 181/282 |
| 3,638,756 | 2/1972 | Thiele | 181/245 |
| 3,650,354 | 3/1972 | Gordon | 181/240 |
| 3,709,320 | 1/1973 | Höllerl et al. | 181/240 |
| 3,827,529 | 8/1974 | Frietzsche et al. | 181/238 |
| 3,852,041 | 12/1974 | Moore et al. | 60/299 X |
| 4,108,274 | 8/1978 | Snyder | 181/229 |
| 4,132,286 | 1/1979 | Hasui et al. | 181/265 |
| 4,396,090 | 8/1983 | Wolfhugel | 181/282 |
| 4,415,059 | 11/1983 | Hayashi | 181/250 |
| 4,422,519 | 12/1983 | Nomura et al. | 181/228 X |
| 4,456,091 | 6/1984 | Blanchot | 181/282 |
| 4,523,660 | 6/1985 | Gaddi | 180/228 |
| 4,700,806 | 10/1987 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,836,330 | 6/1989 | Harwood et al. | 181/282 |

FOREIGN PATENT DOCUMENTS

| | | | |
|---|---|---|---|
| 602279 | 2/1960 | Italy | 181/251 |
| 59-155528 | 9/1984 | Japan . | |
| 59-43456 | 12/1984 | Japan . | |
| 61-155625 | 3/1985 | Japan . | |
| 60-111011 | 6/1985 | Japan . | |
| 61-14565 | 5/1986 | Japan . | |
| 61-108821 | 5/1986 | Japan . | |
| 632013 | 1/1950 | United Kingdom . | |
| 1012463 | 12/1965 | United Kingdom . | |
| 2120318 | 11/1983 | United Kingdom . | |

*Primary Examiner*—Benjamin R. Fuller

*Attorney, Agent, or Firm*—Anthony J. Casella; Gerald E. Hespos

[57] ABSTRACT

A muffler is provided comprising an array of tubes and a stamp formed external shell surrounding the tubes. The external shell is stamp formed to define at least one chamber surrounding at least portions of the tubes. The chamber extends away from peripheral portions of the external shell to define a three-dimensional volume. The chamber is characterized by a plurality of inwardly directed V-shaped grooves, with each groove extending continuously between opposed spaced apart locations on the periphery of each chamber. The grooves preferably define a parallel array of substantially identical grooves. The grooves strengthen the walls of the chamber and efficiently prevent shell noise.

24 Claims, 2 Drawing Sheets

STAMP FORMED MUFFLER WITH REINFORCED OUTER SHELL

BACKGROUND OF THE INVENTION

The typical prior art exhaust muffler has comprised an array of generally parallel tubes supported by transversely extending elliptical or circular baffles. Selected portions of certain tubes typically have arrays of perforations or louvers extending therethrough. Some tubes in the array extend continuously from one baffle to the next, while other tubes may extend shorter distances. This typical prior art muffler further comprises a sheet of metal formed into a generally tubular shell having a cross section corresponding to the elliptical or circular shape of the baffles. The array of baffles and tubes are then slid into the tubular outer shell such that chambers are defined between the shell and adjacent pairs of baffles. The shell is then spot welded to the baffles.

At this point in the construction of the prior art muffler, opposed end caps or headers could b connected to opposed ends of the tubular shell to define a functional exhaust muffler. However, with this construction, it has been found that portions of the shell between adjacent baffles will vibrate in response to the flow of exhaust gases through the muffler. This vibration causes the outer shell of the prior art muffler to effectively function as a drum and produce a shell noise or ringing. To offset this shell noise, most prior art mufflers are provided with an outer wrapper which is wrapped around the tubular shell. The opposed end caps or headers are then mechanically joined to both the shell and the wrapper to complete the prior art muffler. The outer wrapper typically functions to dampen the shell noise.

Some prior art mufflers have been provided with arrays of embossments on the outer wrapper to define air pockets intermediate the outer wrapper and the shell to further contribute to this dampening of shell noise. Examples of mufflers having embossments in either the shell or the outer wrapper are shown in U.S. Pat. No. 2,661,073; U.S. Design Pat. No. 165,057; U.S. Pat. No. 2,151,084 and U.S. Pat. No. 2,835,336, all of which issued to Floyd E. Deremer.

Mufflers have been developed which are formed, at least in part, from stamp formed components. Certain of these prior art mufflers have a pair of plates stamp formed to define an array of parallel tubes. A plurality of transverse baffles support the internal plates and define walls of chambers within this prior art muffler. A conventional tubular outer shell is provided around both the baffles and the stamp formed tubes. A prior art muffler of this type is shown in U.S. Pat. No. 4,396,090 which issued to Wolfhugel on August 2, 1983. U.S. Pat. No. 4,396,090 does not suggest any structure for dealing with the above described shell noise, but presumably could employ the combination of a tubular shell and an outer wrapper as explained above.

Other prior art mufflers have been formed entirely with stamp formed components. Until recently, the stamp formed mufflers achieved relatively little commercial success compared to the above described mufflers with wrapped outer shells. Part of this poor commercial performance of the prior art stamp formed mufflers has been attributable to poor acoustical performance of most such mufflers. In particular, the typical prior art stamp formed muffler has been designed to permit expansion of exhaust gases and/or to achieve a convoluted movement of exhaust gases with a certain amount of noise attenuation associated therewith. However, these prior art stamp formed mufflers have provided little or no attenuation of residual low frequency sounds that cannot be attenuated adequately by expansion chambers, convolutions or the like. Thus, to the extent these prior art stamp formed mufflers were used at all, they typically would have been employed in environments and on vehicles that could have accepted the above described shell noise associated with the drum-like vibrations of the stamp formed muffler shells.

Certain of the fairly simple prior art stamp formed mufflers have considered merely of a pair of opposed outer shells stamp formed to define a convoluted flow path for the movement of exhaust gases. For example, U.S. Pat. No. 2,484,827 which issued to Harley on October 18, 1949, is directed to a muffler having two opposed stamped casing members. Each casing includes a planar peripheral flange. Ridges are formed in each casing, with the bottom of each ridge lying within the plane of the peripheral flange. Parallel corrugations extend out of the plane of the peripheral flange, with the corrugations of one casing being angularly aligned to the corrugations of the other. The casings are mounted together such that the peripheral flanges and ridges thereof are in face-to-face relationship and such that the corrugations extend in opposite directions. The corrugations thus define a single array of interconnected chambers through which exhaust gas may flow.

U.S. Pat. No. 3,176,791 issued to Betts et al. on April 6, 1965, and shows a muffler formed from a pair of opposed stamp formed or molded halves joined to one another along peripheral flanges which are generally planar for most of the body of the muffler. One half of the muffler shown in U.S. Pat. No. 3,176,791 includes a plurality of very deep corrugations, the bottoms of which are generally linear and lie in a plane slightly spaced from the plane of the peripheral flanges. These deep corrugations with the linear bottoms effectively define a plurality of separate chambers. The opposed half of the muffler shown in U.S. Pat. No. 3,176,791 includes a plurality of generally circumferentially extending inwardly directed arcuate grooves which terminate at arcuate ends generally tangent to the plane of the peripheral flange. Each inwardly directed groove effectively defines a continuous arcuate concavity across the entire width of each groove. Additionally, the spacing between adjacent grooves is many times greater than the width of each respective groove.

Substantial improvements to stamp formed mufflers have been developed as shown in U.S. Pat. No. 4,700,806 and U.S. Pat. No. 4,736,817, both of which issued to Jon Harwood and which are assigned to the assignee of the subject invention. The mufflers shown in U.S. Pat. No. 4,700,806 and in U.S. Pat. No. 4,736,817 provide the various advantages of stamp formed manufacturing including fewer components, lighter weight, lower costs and a manufacturing process that is well suited to a high degree of automation. However, and importantly, the mufflers shown in U.S. Pat. No. 4,700,806 and U.S. Pat. No. 4,736,817 can achieve noise attenuation that equals or exceeds the noise attenuation available with the conventional prior art mufflers with wrapped outer shells, and that far exceeds the acoustical tuning available with prior art stamp formed mufflers.

Further improvements to stamp formed mufflers are shown in co-pending applications that are assigned to the assignee of the subject invention. In particular, U.S.

patent application Ser. No. 061,876, now U.S. Pat. No. 4,760,894 shows a stamp formed "EXHAUST MUFFLER WITH ANGULARLY ALIGNED INLETS AND OUTLETS". U.S. patent application Ser. No. 061,913, now U.S. Pat. No. 4,759,423, shows an efficient and effective "TUBE AND CHAMBER CONSTRUCTION FOR AN EXHAUST MUFFLER". U.S. patent application Ser. No. 106,244, now U.S. Pat. No. 4,765,437, is directed to a "STAMP FORMED MUFFLER WITH MULTIPLE LOW FREQUENCY RESONATING CHAMBERS" which enables plural stamp formed tuning tubes and plural low frequency resonating chambers with a significant reduction in the amount of deformation required in the stamp formed outer shells. U.S. patent application Ser. No. 146,032, now U.S. Pat. No. 4,821,840, is directed to a "STAMP FORMED MUFFLER WITH CONFORMAL OUTER SHELL" which enables the muffler to efficiently conform to the limited available space on a vehicle. The disclosures of the above identified patents and applications assigned to AP Industries, Inc. are incorporated herein by reference.

Referring to U.S. Pat. No. 4,700,806 and U.S. Pat. No. 4,736,817, it will be noted that a plurality of outwardly extending stamp formed reinforcing ribs are disposed on the major planar surfaces of the chambers formed in the external shell. Although ribs of this general construction contribute to a stiffening of the external shells, it is desirable to further prevent shell noise. Although separate wrappers or shells as used with conventional mufflers presumably could reduce shell noise, they would also add substantially to the weight and cost of the muffler. Similarly, a plurality of very deep creases as in the above referenced U.S. Pat. No. 2,484,827 and U.S. Pat. No. 3,176,791 also might reduce shell noise. However, these creases are difficult to form and make it difficult to achieve the acoustically required chamber volumes within the available space on the vehicle. Various patterns of outwardly convex arcuate ribs as shown in U.S. Pat. No. 4,700,806 and similar patterns of inwardly concave arcuate channels disposed on the major planar surfaces of the external shell have been experimented with. However, these various attempts have not adequately eliminated shell noise.

In view of the above, it is an object of the subject invention to provide a stamp formed muffler that effectively reduces shell noise to acceptable levels.

It is a further object of the subject invention to provide a stamp formed muffler having at least one external shell that is reinforced to substantially avoid or offset shell related noise.

SUMMARY OF THE INVENTION

The muffler of the subject invention comprises an array of tubes and at least one chamber enclosing at least portions of the tubes. The tubes are provided with means for permitting a controlled flow of exhaust gases therefrom, such as perforations, louvers, apertures or the like. Preferably, the tubes are defined by a pair of plates secured in face-to-face relationship. More particularly, the plates may be formed to define at least one array of channels. Thus, a channel formed in one plate and the opposed portion of the other plate define a tube therebetween. For example, each plate may be formed with at least one array of channels disposed such that the channels of one plate are generally registered with the channels of the other plate when the plates are secured in face-to-face relationship. However, on at least certain areas of the plates, one channel may be disposed adjacent a planar portion of the other plate. The deformation of the plates to define the channels preferably is carried out by stamp forming sheets of metal. However, other known deformation processes may be employed, such as processes employing hydraulic forces, magnetic forces or explosive forces. The array of tubes of the muffler is disposed to define at least one inlet and at least one outlet which are connectable to pipes of an exhaust system.

The chamber of the muffler is defined by at least one external shell which is formed to surround at least portions of the tubes. The formation of the external shell preferably is carried out by stamp forming processes, but may alternatively be carried out by the other known deformation processes identified above.

The external shell may comprise a peripheral portion from which the formed chamber extends. The peripheral portion of one shell may be secured to a second external shell to surround at least portions of the tubes of the muffler. Alternatively, portions of the shell surrounding the chamber may be secured to at least one of the above described plates which is formed to define the array of tubes. In one preferred embodiment, a pair of external shells are secured respectively to the opposed sides of a pair of internal plates which are formed to define tubes. Thus, the chambers defined by the external shells surround and enclose at least portions of the tubes formed by the internal plates. At least one of the external shells may be formed to define a plurality of chambers with a crease separating adjacent formed chambers from one another.

Each chamber formed in the external shell necessarily defines a three-dimensional volume extending away from peripheral portions of the chamber. These peripheral portions of the chamber may lie entirely or substantially within a common plane, and may be defined by a generally planar peripheral flange. The chamber extending away from these peripheral portions may comprise a plurality of interconnected side walls and a connecting wall extending between the side walls. By virtue of the formed construction of the external shell and each chamber therein, the peripheral portions and the various walls of the chamber preferably are of unitary construction. The side walls and the connecting wall may be generally planar with curved or radiused intersections. However, in some embodiments, the side walls and the connecting wall may be generally arcuate. The precise configuration of the chamber formed in the external shell will be determined both by the acoustical requirements of the muffler and the available space on the vehicle.

As noted above, the rapid movement of exhaust gases through the muffler can create vibrations in the shell which in turn generate a shell noise which is supplemental to the noise generated directly by the exhaust gases. Prior art mufflers have included a double wall comprising a generally tubular shell and an outer wrapper disposed thereabout to dampen the shell noise. Prior art stamp formed mufflers, as explained above, have included various arrays of arcuate ribs, grooves or deep convolutions.

The subject muffler achieves superior attenuation of shell noise by providing an array of generally V-shaped inwardly directed grooves in the formed external shell of the muffler. The grooves preferably extend continuously from one peripheral location on the formed chamber to an opposed peripheral location thereon. Thus, each groove may extend continuously across the connecting wall and two opposed side walls of the chamber the entire distance between two peripheral portions of the chamber. On external shells provided with peripheral flanges, each groove may extend from one location on a peripheral flange to an opposed location thereon. More particularly, each groove comprises an elongated base defining the deepest portion of each groove. These bases may extend the entire distance to the peripheral portion of the external shell to intersect or be part of the peripheral portion. Thus, a planar portion of a peripheral flange adjacent to the side walls of the formed chamber may be characterized by a plurality of generally V-shaped scallops corresponding in shape to the cross section of each groove, with the deepest part of each such scallop in the peripheral flange being adjacent the base of the associated groove.

The array of grooves may define a generally parallel array, with the base of each groove in the array being non-linear, but lying generally in a single plane. This plane defined by the base of each groove may be orthogonal to the plane of the peripheral portion of the shell. The depth of each groove on the side wall portions of each chamber may be approximately equal to the depth of the groove on the connecting wall portions of the chamber. Alternatively, the depth of each groove may be greater adjacent the intersection of the connecting wall and the side walls of each chamber. For example, the base of each groove may define an arc extending between spaced apart peripheral locations on each chamber, while the side walls and the connecting wall of the chamber may be generally planar.

Each groove may be defined by generally planar inwardly directed walls which intersect to define the V shape. Each wall of the V-shaped groove may intersect the chamber walls to define an outwardly convex arcuate surface. The planar walls of each groove may intersect each other at a concave arcuate groove.

The muffler may be designed such that the grooves are spaced slightly from the tubes within each chamber. Thus, noise generated by vibration between the tubes and the external shell is avoided. In a preferred embodiment, the muffler comprises an array of generally parallel tubes therein, with the grooves in the outer shell being generally transverse to the parallel tubes of the muffler.

DETAILED DESCRIPTION OF THE PREFERRED EMBODIMENT

Figure 4:
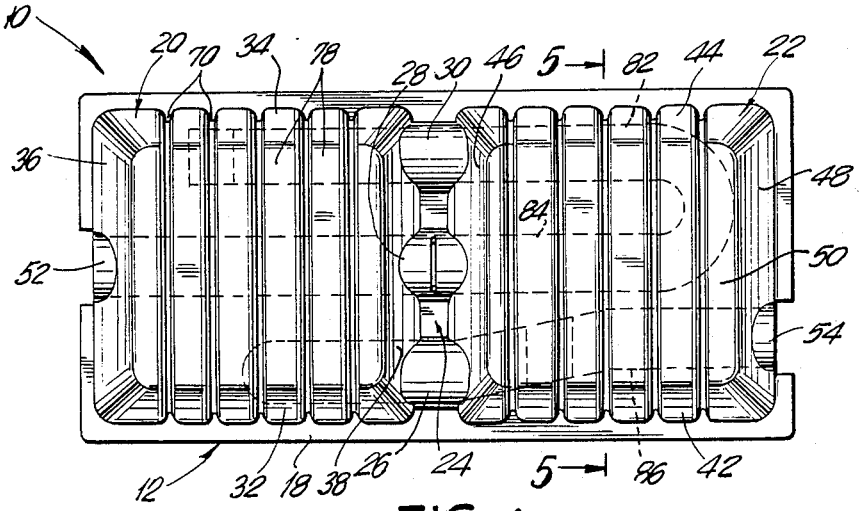
FIG. 4 is a top plan view of the muffler shown in FIG. 1.
Figure 5:
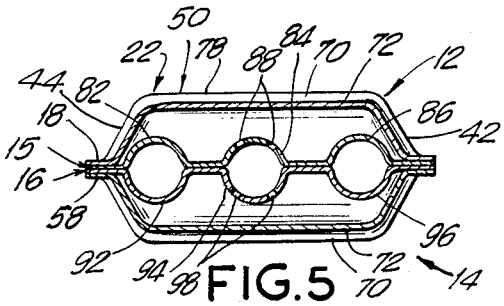
FIG. 5 is a cross-sectional view taken along line 5—5 in FIG. 4.

The muffler of the subject invention is identified generally by the numeral 10 in FIGS. 1–5. The muffler 10 comprises first and second stamp formed external shells 12 and 14 which surround an array of tubes disposed within the muffler. In the illustrated embodiment, the tubes are defined by internal plates 15 and 16 which are secured in face-to-face relationship with one another. The internal plates 15 and 16 each are formed to define arrays of channels, as shown in FIGS. 4 and 5. The channels are disposed generally in register with one another on the interconnected plates, such that opposed channels define tubes therebetween. Selected portions of the tubes defined by the formed internal plates 15 and 16 are provided with perforations, louvers, apertures or the like to permit controlled flow of exhaust gases therefrom as explained herein.

Each external shells 12 and 14 are formed from unitary sheets of metal to define a plurality of chambers. More particularly, the first external shell 12 is formed to define a generally planar peripheral flange 18 and chambers 20 and 22 extending therefrom. The chambers are separated from one another by a formed crease 24 at least portions of which lie generally in the same plane as the peripheral flange 18. The crease 24 is characterized, however, by outwardly convex arcuate portions 26, 28 and 30 which extend between and connect the chambers 20 and 22, and which are disposed and dimensioned to engage the tubes within the muffler. Other embodiments may have a different number of convex portions extending between the chambers depending on the internal pattern of tubes.

The chamber 20 is defined by opposed generally trapezoidal side walls 32 and 34 and by opposed generally trapezoidal end walls 36 and 38. The side and end walls 32–38 are all angularly aligned to the plane of the peripheral flange 18 at angles of approximately 60°. As shown most clearly in FIG. 3, the radius of curvature "a" at the juncture of the peripheral flange 18 and the side or end walls 32–38 is approximately equal to 0.25 inch. The side walls 32 and 34 of the chamber 20 are unitarily connected to the end walls 36 and 38 to define a generally truncated pyramidal shape. A connecting wall 40 extends between and connects the side and end walls 32–38 at an arcuate intersection having a radius "b" of about 1.00 inch.

The chamber 22 is substantially similar to the chamber 20, but not necessarily of the same volume. More particularly, the chamber 22 includes opposed generally trapezoidal side walls 42 and 44 and opposed generally trapezoidal end walls 46 and 48. A connecting wall 50 extends between and connects the side and end walls 42–48 such that the chamber 22 also is of generally truncated pyramidal shape.

It will be noted that the end wall 36 of chamber 20 and the end wall 48 of chamber 22 are characterized respectively by inlet and outlet flanges 52 and 54 respectively. More particularly, the inlet and outlet flanges 52 and 54 are disposed to surround and engage inlet and outlet tubes of the muffler and to enable the muffler to be connected to the exhaust pipe and tail pipe of an exhaust system.

Figure 1:
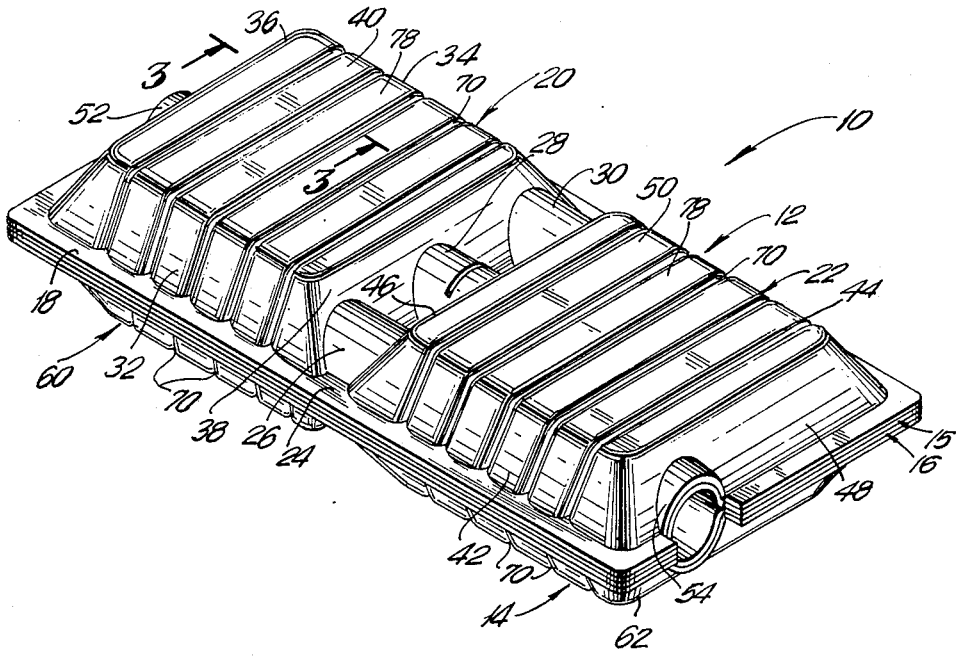
FIG. 1 is a perspective view of the muffler of the subject invention.
Figure 2:
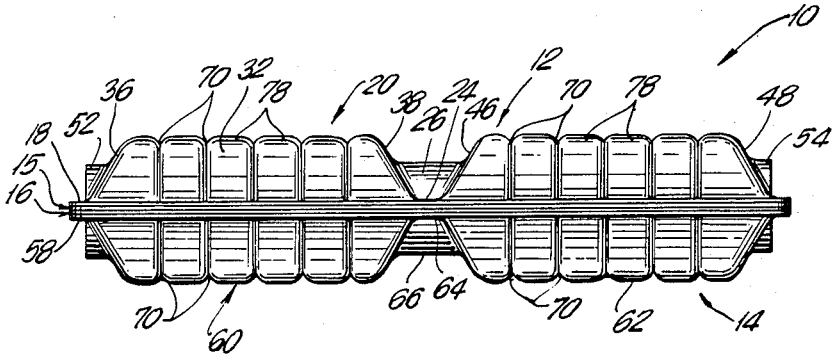
FIG. 2 is a side elevational view of the muffler shown in FIG. 1.

As shown most clearly in FIG. 2, the external shell 14 is substantially a mirror image of the external shell 12. In particular, the external shell 14 is defined by a peripheral flange 58 and generally truncated pyramidal chambers 60 and 62 extending therefrom. The chambers 60 and 62 are separated from one another by a transversely extending crease 64 at least a portion of which lies generally in the same plane as the peripheral flange 58. The crease 64 is characterized by outwardly convex portions such as convex portion 66, which is disposed and dimensioned to engage a tube of the muffler.

To prevent shell noise, the chambers 20 and 22 of external shell 12 and the chambers 60 and 62 of external shell 14 are characterized by arrays of generally parallel inwardly directed generally V-shaped grooves 70. The grooves 70 are spaced from one another by dimension "c" which is between 1.00 inch and 3.00 inches, and which preferably is approximately equal to 1.5 inches. The grooves 70 are disposed in a parallel array to extend generally orthogonal to the alignment of the generally parallel tubes of the muffler as shown in FIGS. 4 and 5. More particularly, the grooves 70 extend substantially continuously between opposed spaced apart locations on the peripheral flange 18, 58 such that each groove 70 lies generally within a plane extending orthogonally from the plane of the peripheral flange 18, 58. Thus, with reference to the chamber 20 of external shell 12, each groove 70 extends continuously across the connecting wall 40 and along the opposed side walls 32 and 34 the entire distance to spaced apart locations on the peripheral flange 18.

Each groove 70 comprises a base portion 72 which is inwardly concave. The base portion 72 of each groove 70 is defined by two intersecting generally planar surfaces 74 and 76. Adjacent grooves 70 are separated by planar portions 78 which intersect the grooves 70. The sharp angles required for the intersection of planar surfaces is difficult to achieve with many metallic materials. Therefore, it is preferred that the planar surfaces 74 and 76 of each groove 70 intersect the planar surfaces 78 between grooves 70 at slightly outwardly convex arcuate surfaces 75 and 77 respectively which define radii "d" of approximately 0.50 inch. For the same reason, the base 72 defines an inwardly concave arcuate surface of radius "e" which equals approximately 0.06 inch. Thus, the surfaces 75 and 77 defined an outward radius "d" which is 6–10 times greater than the inward radius "e" of base 72.

In one preferred embodiment, as depicted most clearly in FIG. 5, the base 72 of each groove 70 defines a substantially constant depth "f" of approximately 0.25 inch measured perpendicular to adjacent surfaces 78 of the associated chamber at any location along the entire length of each groove 70, including portions thereof disposed on the side walls 32 and 34. In particular, the depth "f" of each groove 70 measured perpendicular to a side wall 32, 34, 42, 44 approximately equals the depth "f" measured perpendicular to the connecting walls 40 and 70. As a result, the generally planar peripheral flange 18, 58 defines a generally scalloped configuration corresponding to the cross-sectional shape of each groove 70 at the intersection of the peripheral flange 18, 58 with the respective grooves 70. This scalloped configuration is shown most clearly in FIG. 4.

As noted above, and as shown in FIG. 4, the grooves 70 extend generally transverse to the alignment of the tubes formed by the plates 15 and 16. More particularly, as shown in FIG. 5, the plate 15 comprises generally longitudinally extending channels 82, 84 and 86. The channel 84 is provided with perforations 88 extending therethrough to permit expansion of exhaust gases into the chamber 22. Similarly, the plate 16 is formed to define channels 92, 94 and 96, with the channel 94 being provided with perforations 98 extending therethrough to permit communication with the chamber 62. The plates 15 and 16 are connected such that the channels 82–86 of plate 15 are in register with the channels 92–96 of the plate 16 to define tubes therebetween. The channels 82–86 and 92–96 are disposed to be in spaced relationship relative to the base portions 72 of the grooves 70 as shown in FIG. 5. As a result, there will be no noise generated by vibrations between the internal plates 15 and 16 and the external shells 12 and 14. However, the tubes should be as close to the bases 72 of grooves 70 as possible to minimize the amount of metal deformation required in the vicinity of the creases 24, 64 and the arcuate portions therein. In other embodiments, the bases 72 of grooves 70 may be fixedly held against the tubes to prevent vibration.

Figure 6:
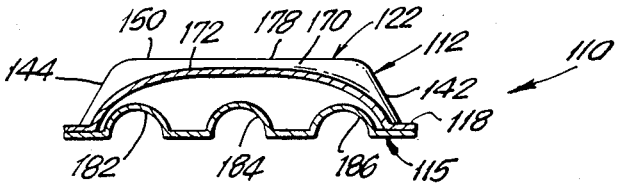
FIG. 6 is a partial cross-sectional view similar to FIG. 5 but illustrating an alternate external shell of the subject invention.
Figure 3:
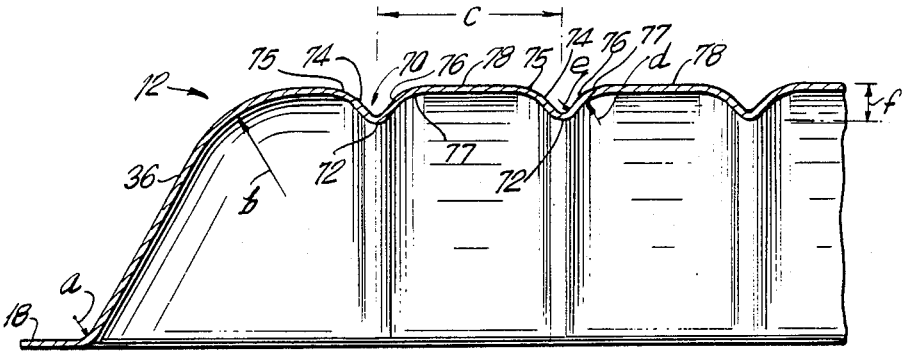
FIG. 3 is a cross-sectional view taken along line 3—3 in FIG. 1.

FIG. 6 shows a partial cross section of a muffler 110 which is similar to the muffler 10 in FIG. 5, but with an alternate external shell 112 having a peripheral flange 118 and a chamber 122 extending therefrom. The chamber 122 includes side walls 142 and 144 and a connecting wall 150. The external shell 112 is further formed to comprise grooves 170 extending between spaced apart locations on the peripheral flange 118. The base 172 of groove 170 lies in a single plane, and is spaced from the internal plate 115 and the channels 182–186 formed therein. However, the grooves 170 are not of constant depth relative to the portions 178 between adjacent grooves 170, as had been the case with the embodiment described and illustrated above. More particularly, the base 172 of each groove 170 defines a substantially continuous outwardly convex arc along its length as shown in FIG. 6. The portions 178 of the external shell 112 between the grooves 170, however, define the same generally trapezoid shape which exists on the previously described and illustrated embodiments. Thus, each groove 170 is effectively deeper near the intersection of the connecting wall 150 and the side walls 142 and 144. The configuration of grooves 170 illustrated in FIG. 6 is believed to be more effective in eliminating shell noise in certain instances.

In summary, the muffler comprises a pair of internal plates secured in face-to-face relationship, and stamp formed to define an array of tubes therebetween. A pair of stamp formed external shells are secured to opposed sides of the internal plates. The external shells are stamp formed to define a plurality of chambers which communicate with the tubes defined by the internal plates. To prevent shell noise, the chambers of the external shells are provided with a generally parallel array of inwardly directed V-shaped grooves extending continuously between spaced apart peripheral locations on each external shell. The inwardly directed grooves are defined by angularly aligned intersecting surfaces. Each of the intersecting surfaces defining the grooves may comprise slightly convexly outwardly arcuate surfaces. Each groove preferably extends to and intersects the peripheral flange of the external shell, with the base of each groove being spaced from the plane of the peripheral flange.

While the invention has been described with respect to a preferred embodiment, it is apparent that various changes can be made without departing from the scope of the invention as defined by the appended claims.

What is claimed is:

1. An exhaust muffler comprising:

an array of tubes comprising an inlet to the muffler and an outlet from the muffler; and at least one external shell defining a peripheral portion and at least one chamber extending from the peripheral portion, said chamber comprising a plurality of chamber walls, including side and end walls extending from said peripheral portion and a connecting wall extending between and connecting portions of said side and end walls spaced from said peripheral portion, an array of generally V-shaped inwardly directed grooves, said generally V-shaped grooves of said array extending continuously between spaced apart locations on the peripheral portion of said chamber, each said V-shaped groove comprising a pair of opposed intersecting groove surfaces which respectively intersect the chamber walls at outwardly convex arcuate surfaces, the groove surfaces intersecting one another at an inwardly concave arcuate portion defining a radius of curvature smaller than the outwardly convex arcuate portions of the groove, whereby said grooves substantially prevent noise associated with vibration of said external shell.

2. A muffler as in claim 1 wherein the peripheral portion of said chamber comprises a peripheral flange, said grooves of said array intersecting and connecting spaced apart locations on said peripheral flange.

3. A muffler as in claim 1 wherein said chamber comprises generally planar wall portions intermediate adjacent V-shaped grooves of said array.

4. A muffler as in claim 3 wherein each said groove of said array comprises a base portion, said base portion of each said groove in said array extending generally parallel to the generally planar portions of said chamber intermediate said grooves.

5. A muffler as in claim 3 wherein in each said V-shaped groove in said array comprises a pair of outwardly convex arcuate surfaces intersecting the planar wall portions of said chamber between adjacent grooves.

6. A muffler as in claim 1 wherein the outwardly convex portions each define a radius which is six to ten times as great as the radius of the inwardly concave portion.

7. A muffler as in claim 1 wherein the tubes of said muffler are disposed in a generally parallel array, and wherein the inwardly directed V-shaped grooves are aligned generally transverse to the tubes of the muffler.

8. A muffler as in claim 7 wherein the grooves are generally parallel.

9. A muffler as in claim 7 wherein the inwardly directed grooves of the muffler are disposed in spaced relationship to the tubes of the muffler.

10. A muffler as in claim 1 wherein each said groove defines a uniform depth of approximately 0.50 inch.

11. A muffler as in claim 1 wherein the grooves are generally parallel.

12. A muffler as in claim 1 wherein each groove comprises a base, said base being spaced from the plane of said peripheral flange at all locations between the opposed ends of said groove.

13. A muffler as in claim 12 wherein each said groove is of substantially uniform depth.

14. A muffler as in claim 12 wherein the base of each groove defines an outwardly convex arc along the length of the groove.

15. A stamp formed exhaust muffler comprising:

first and second internal plates secured in face-to-face relationship and stamp formed to define an array of channels, said channels being disposed such that the channels of one internal plate and the channels of the other internal plate define an array of tubes therebetween, selected tubes in said array being provided with perforation means for permitting communication of exhaust gases therefrom, selected tubes in said array defining at least one inlet to the muffler and at least one outlet from the muffler; and a pair of external shells defining peripheral portions, said external shells being stamp formed to define at least one chamber extending from said peripheral portions, said external shells being secured to the internal plates and enclosing at least selected tubes formed therein, at least one chamber of said external shells comprising a pair of opposed side walls extending from the peripheral portions and a connecting wall extending unitarily between and connecting said side walls, said chamber being formed to define an array of generally inwardly directed generally V-shaped grooves extending continuously across said connecting wall and said side walls from opposed locations on said peripheral portion, each said inwardly directed V-shaped groove of said array comprising a pair of outwardly convex arcuate surfaces, a pair of converging generally planar surfaces extending from said convex surfaces, said planar surfaces intersecting at an inwardly concave arcuate surface, said inwardly concave arcuate surface defining a base of said V-shaped groove, said outwardly convex arcuate surfaces defining radii which exceed the radius of the inwardly concave arcuate surface of each said V-shaped groove.

16. A muffler as in claim 15 wherein said peripheral portion defines a flange, said flange being of generally V-shaped scalloped configuration adjacent the intersection of said peripheral flange with said V-shaped grooves.

17. A muffler as in claim 15 wherein said V-shaped grooves of said array each define a length and are of substantial uniform depth along their respective lengths.

18. A muffler as in claim 15 wherein said base of each said V-shaped groove in said array defines an outwardly convex arc along the length of the groove.

19. A muffler as in claim 15 wherein the V-shaped grooves of said array are spaced from one another by a distance of between 1.00 and 3.00 inches.

20. A muffler as in claim 15 comprising generally planar portions intermediate adjacent grooves in said array.

21. A muffler as in claim 15 wherein at least one of said external shells is formed to define a plurality of chambers, each said chamber being characterized by an array of said V-shaped grooves, with the grooves in each said array being generally parallel to one another.

22. A muffler as in claim 21 wherein each said external shell is formed to define two chambers, each of said chambers further being formed to define an array of parallel inwardly directed V-shaped grooves, the grooves of said arrays being generally parallel to one another.

23. A muffler as in claim 15 wherein the grooves of said array are generally parallel.

24. An exhaust muffler comprising:

first and second internal plates secured in face-to-face relationship and stamp formed to define an array of channels, said channels being disposed to define an array of tubes between said plates, said tubes defining an inlet to the muffler and an outlet from the muffler, selected tubes in said array being provided with perforation means for permitting communication of exhaust gases from said tubes; and a pair of external shells defining peripheral flanges disposed in face-to-face relationship, said external shells being formed to define chamber walls extending from said peripheral flanges and defining at least one chamber surrounding at least selected tubes of said muffler, said chamber walls being formed to define a plurality of grooves extending continuously across the chamber walls and connecting opposed locations on said peripheral flanges, such that portions of said peripheral flanges aligned with said grooves are wider than portions of said peripheral flanges aligned with the chamber walls intermediate said grooves such that the peripheral flanges are of generally scalloped configuration adjacent the chamber walls.

* * * * *